United States Patent [19]

Schmodde

[11] Patent Number: 4,643,003

[45] Date of Patent: Feb. 17, 1987

[54] CAM SYSTEM AND METHOD FOR COMBINED LOOP FORMATION AND TRANSFER IN FLAT-BED KNITTING MACHINES

[75] Inventor: Hermann Schmodde, Albstadt, German Democratic Rep.

[73] Assignee: H. Stoll GmbH & Co., Fed. Rep. of Germany

[21] Appl. No.: 775,559

[22] Filed: Sep. 13, 1985

[30] Foreign Application Priority Data

Sep. 13, 1984 [DE] Fed. Rep. of Germany ..... 3433628

[51] Int. Cl.[4] ..... D04B 7/00

[52] U.S. Cl. ..... 66/78

[58] Field of Search ..... 66/64, 70, 76, 78

[56] References Cited

U.S. PATENT DOCUMENTS

| | | | |
|---|---|---|---|
| 4,012,927 | 3/1977 | Kühnert | 66/78 |
| 4,154,067 | 5/1979 | Grimmer et al. | 66/78 |
| 4,463,579 | 8/1984 | Schimko et al. | 66/78 |
| 4,470,274 | 9/1984 | Shima et al. | 66/78 |
| 4,545,219 | 10/1985 | Schmodde | 66/70 |

*Primary Examiner*—Ronald Feldbaum

*Attorney, Agent, or Firm*—Jones, Tullar & Cooper

[57] ABSTRACT

A cam system for flat-bed knitting machines is provided with a needle cam unit which has at least one knitting cam and a transfer cam, integrated therein, for both carriage travel and transfer directions. The knitting cam has adjustable needle sinkers and a knitting cam/knitting element that projects the needles for knitting, and the transfer cam has at least one delivery transfer element and an associated receiving transfer element. The needles, which are supported in needle tracks of the needle beds, are controlled by intermediate jacks embodied as pressure elements, the pressure feet of which can be moved along various courses, which are located in the planes of pressure bars. In order to be able to perform combined loop formation and loop transfer in a single cam unit in a single operation, using a single needle, in such a cam system, the knitting cam/knitting element simultaneously embodies the receiving transfer element of the transfer cam. Four different courses or planes of pressure bars are provided; the first of these effects the delivery transfer movement, the second the loop formation and/or loop receiving movement, the third the tuck position, and the fourth the non-working position.

9 Claims, 4 Drawing Figures

CAM SYSTEM AND METHOD FOR COMBINED LOOP FORMATION AND TRANSFER IN FLAT-BED KNITTING MACHINES

FIELD OF THE INVENTION

The present invention relates to a cam system for flat-bed knitting machines, having a needle cam unit with at least one knitting cam and an integrated transfer cam for both carriage travel and transfer directions. The knitting cam has adjustable needle sinkers and a knitting cam/knitting element that projects the needle for knitting, while the transfer cam has at least one delivering cam element and an associated receiving cam element. The invention also relates to a method for forming and transferring loops on a flat-bed knitting machine with front and rear needle beds in which loops are transferred from one bed to another, preferably with latch needles acting as knitting needles during the loop formation and as transfer needles during loop transfer.

BACKGROUND OF THE INVENTION

Cam systems of the above type are used in so-called combination cams of flat-bed knitting machines and are provided with both at least one knitting cam and at least one transfer cam integrated in it (for instance, see German patent disclosure document DE-OS No. 31 38 981). However, a combined knitting and transfer cam of this kind can be used in one carriage travel direction only as either a knitting cam or a transfer cam, and can only be used as the other kind, i.e., a transfer cam or a knitting cam, respectively, in the carriage return direction. Accordingly, and as described in the above reference, double knitting cam systems have come to be used, in which two of the above cam systems having a combined knitting/transfer cam are used in sequence, or come into action in succession, in the carriage travel direction.

It is then possible for the leading cam in the carriage travel direction to be used for knitting, for instance for a certain number of needles, and for the trailing cam in the carriage travel direction to be used for transfer, for instance from some other number of needles, or the same needles, or some of the same needles. Here again, however, knitting and transfer can only be performed in succession, by two different cams.

SUMMARY OF THE INVENTION

It is accordingly an object of the present invention to provide a cam system for flat-bed knitting machines of the above general type, as well as a method, for forming and transferring loops, in which the above-described disadvantages are avoided and in which loop formation and loop transfer can be performed combined in a single cam unit and in a single operation, using a single needle.

This object is attained, in a cam system of the above general type, by means of a knitting cam and knitting element which simultaneously embodies the receiving cam element of the transfer cam, and by a method as defined herein.

Thus it is possible in accordance with the invention to perform loop formation and loop transfer with one and the same needle cam unit, that is, in one operation or projection stroke. This is effected in that the needle that is receiving the loop from the delivering needle of the other needle bed is not, as in previously known systems and methods, projected merely far enough that the loop that is to be transferred is located between the hook and the latch of the needle; instead, it is projected substantially as far as the delivering needle, so that the loop that is to be transferred moves behind the opened needle latch and comes to rest there; in this projected position, the hook of the receiving needle can grasp a new yarn. After the knockover of the delivering needle, the receiving needle is then knocked over, so that the yarn for the loop that is to be formed next is drawn through the loop that has just been received. By means of this simultaneous loop transfer and loop formation, faster knitting is possible; secondly, a single cam system can be used instead of a double cam system; and finally, the cam system thereby becomes narrower, which results in a more favorable production cost of the flat-bed knitting machine.

In cases in which a shift in the knitted pattern must be made, in order to enable transferring a loop without forming a new loop as well, the combined knitting and receiving cam element is divided in two, in one exemplary embodiment of the present invention, and in its upper portion it is indexable.

If the needles in such a cam system, which are supported in needle tracks of the needle beds, are controlled by intermediate jacks embodied as pressure elements, the pressure feet of which are movable selectively into different courses, which are located in the planes of pressure bars, then according to a further exemplary embodiment it is useful to provide four different courses or planes of pressure bars, one of which effects the delivery movement, the second the loop forming and/or loop receiving movement, the third the tuck position and the fourth the non-working position. These four possibilities enable the full exploitation of all four planes. This is in contrast to the situation known previously, where in a double cam system there were two cam units located one behind the other, and so only three of these four courses or planes could be used. For one cam unit, only the courses for loop formation, the tuck position and the non-working position could be used, while for the other cam unit only those for the delivery movement, the receiving movement and the non-working position could be used.

In such a case, where pressure bars are provided for selecting the individual cam tracks, it can be useful to provide an indexable pressure bar in the second plane in the region underneath the knitting cam or knitting element, so that in this way (instead of having the particular cam element be indexable), there can be a receiving movement without loop formation.

According to another exemplary embodiment of the present invention, the individual cam elements are disposed in a space-saving manner by providing that the leading needle sinker, which simultaneously is the loop delivering cam element, and an intermediate cam element provided between the needle sinker and the combined knitting/receiving cam element are disposed in such a way as to provide three projection or knockover tracks, which come into action in succession and meet or intersect in a region above the combined knitting-/receiving cam.

DESCRIPTION OF THE PREFERRED EMBODIMENT

Figure 1:
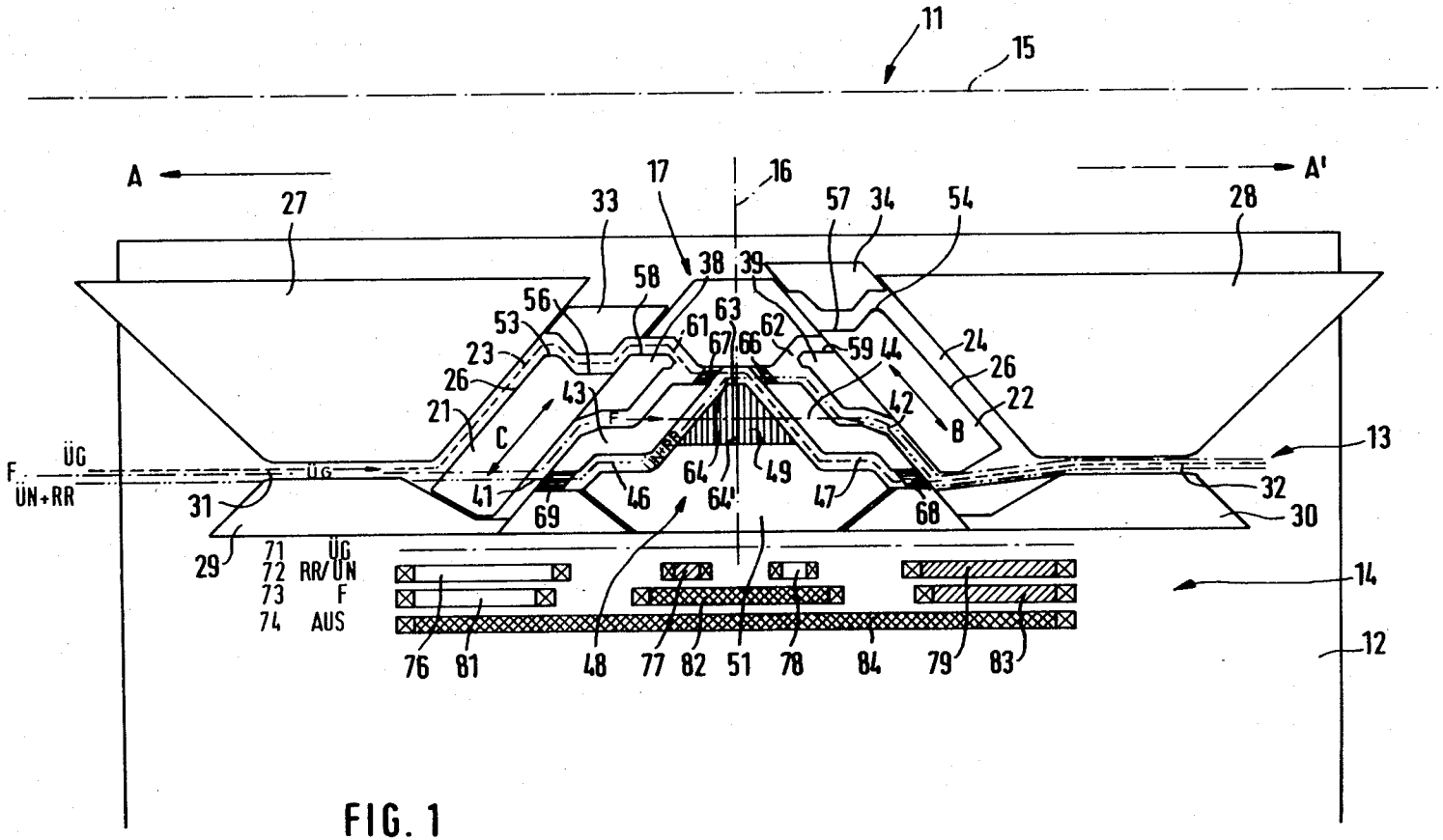
FIG. 1 is a schematic plan view on a carriage, provided with a cam system according to a preferred exemplary embodiment, of a needle bed of a flat-bed knitting machine, although cams for selection jacks and an electromagnetic selection apparatus are not shown.

The cam system 11 for flat-bed knitting machines shown in FIG. 1, of which only one needle bed—in this instance the front needle bed—is shown, is movable by means of a carriage 12 that travels back and forth in the direction of the arrows A and A'. The front part of the cam system 11 shown here, which is identical to the rear part of the cam system 11 that is located symmetrically with respect to the longitudinal axis 15, has a needle cam unit 13, below which is a pressure bar unit 14 for intermediate jacks (not shown) connected to the needles, and also has, for instance, two selection jack cam units, disposed one under the other but not shown here, and two selection cam units, also not shown here, which serve to select the associated selection jacks electromagnetically. The units in the cam system according to the invention which are mentioned above but not shown here are described, for example, in U.S. Pat. No. 4,554,803. The needle cam unit 13, which is symmetrical with respect to a transverse plane 16, is embodied as a combined knitting/transfer cam assembly 17 and accordingly has a knitting cam and, combined or integrated with it, a transfer cam, the elements or parts of which are intermeshed with one another.

In the combined or integrated knitting/transfer cam assembly 17, there are two spaced-apart knockover elements or needle sinkers 21, 22, which are adjustable along oblique lines pointing toward one another as indicated by the double arrows C and B, in order to adjust the loop width while knitting or the like. Stationary trapezoidal cam elements 27 and 28, which are supported on their head or narrower portion, are disposed opposite an outer flank 26 of the needle sinkers 21, 22, respectively forming a rising needle track 23 and a descending needle track 24. At their head end, the cam elements 27 and 28 face a further stationary cam element 29, 30, respectively forming a feed track 31 and a discharge track 32. Above the needle sinker 21, 22, there is an additional cam element 33, 34 which is adjustable in the same direction as the needle sinker and is thus rigidly joined to it; at its full width, the cam element 33, 34 extends as far as the trapezoidal cam element 27, 28 and thus defines the top part of the track 23, 24.

Respective stationary bar elements 38, 39 rest on the inner flanks of the needle sinker 21, 22, that is, the flanks thereof which face towards one another, and the bar elements 38, 39 are shorter than the needle sinkers 21, 22. Stationary intermediate cam elements 43 and 44 are located facing the inner flanks of the bar element 38, 39 and of the needle sinker 21, 22, thereby forming a track 41 and a track 42. The intermediate cam elements 43 and 44 have an elongated, bent shape. Between the two intermediate cam elements 43 and 44, and likewise forming a respective rising and descending track 46 and 47, is a knitting cam/knitting element 48, which comprises an upper, indexable region 49, which is approximately triangular or trapezoidal in shape, and a lower, stationary region 51, which becomes wider in stepwise fashion.

The cam elements described so far are components of both the knitting cam and the transfer cam of the combined knitting/transfer cam assembly 17. Thus, the needle sinkers 21 or 22, along with the bar element 38 or 39, serve to effect delivery by the needles of one needle bed, while reception by the needles of the other needle bed is effected by the knitting cam/knitting element 48. Loop formation and tuck position are effected by the knitting cam/knitting element 48 and the intermediate cam element 43 or 44, respectively.

The needle sinkers 21, 22 have a biasing lobe 53, 54 and, adjacent to it in the direction of the bar element 38, 39, an indentation 56, 57. In the delivery position (see the left needle sinker 21 in FIG. 1), the leading needle sinker 21, together with the bar element 38 resting on it, forms a delivery lobe 58, which in the exemplary embodiment is at the same height as the biasing lobe 53, 54. It is also possible, however, for the leading needle sinker 21, 22 to be moved into such a position that the biasing lobe 53, 54 is higher than the delivery lobe 58, 59. The delivery lobe 58, 59 extends over substantially the same top side of the bar element 38, 39, as far as a descending track portion 61. As FIG. 1 also shows, the trailing needle sinker 22 (on the right in FIG. 1) serves, when adjusted upward, in the usual manner as a knockover element for the needles after the loop has been formed. The knitting cam/knitting element 48 which is located below the leading needle sinker 21 and below the bar element 38, acts as a knitting and receiving cam element. The knitting cam/knitting element is symmetrical in structure and is arranged in such a way that the first ascent in succession in the carriage travel direction A or A' begins below the indentation 56 or 57, and the second ascent in succession begins below the delivery lobe 58 ro 59. The shared receiving lobe 64 is disposed below and between the descending and ascending track portions 61, 62.

As shown in FIG. 1, the progression of the individual events in the operation is as follows:

A needle ÜG, which is to deliver a loop to the needle of the other needle bed, enters the feed track 31 with its needle foot and ascends via the first track 23 between the cam element 27 and the needle sinker 21; then via the biasing lobe 53, the indentation 56 and the deliver lobe 58 it enters the descending track 61, then moves via a horiziontal intermediate portion 63 into the first knockover track, along the rear flank of the knitting cam/knitting element 48, and from there moves underneath the trailing needle sinker 22 to enter the discharge track 32. The deflection of the delivery needle UG from the intermediate track portion 63 into the first knockover track 47 is effected by means of a cam element 66, 67 which is in the way of the ascending rack 62; this element 66, 67 is also in the way between the descending track 61 and the horizontal intermediate track portion 63 and in the opposite direction is embodied as a suppressor cam element. As a result of this, the delivering needle ÜG can move from the descending track 61 into the horizontal intermediate portion 63, because it is pressed into the needle bed. In a corresponding manner, a suppressor cam element 68, 69, which as the trailing cam element has the suppressor function in the carriage travel direction A and A', respectively, is located between the end of the first knockover track 47 and the end of the second knockover track 42, that is, the beginning of the discharge track 32, below the needle sinker 22, and correspondingly on the other side of the cam as well. With its needle foot, a particular needle F that is supposed to move into the tuck position moves via the feed track 31 and underneath the leading needle sinker 21, in a manner that will be described in greater detail below; deflected by the cam element 68, it enters the second projection track 41 and assumes the tuck position, which corresponds to the horizontal part of the bend of the intermediate cam element 43. From there, as will be described below, the needle moves underneath the intermediate cam element 43, the knitting cam/knitting element 48 and the intermediate cam element 44 and on into the second knockover track 42 and under the needle sinker 22 and into the discharge track 32.

The particular needle ÜN+RR, which is intended to perform a combined receipt of a loop from the needle of the other needle bed and a loop formation, also travels with its needle foot through the feed track and then, in a manner to be described below, underneath the needle sinker 21 and the cam element 69 into the third projection track 46 as far as the horiziontal intermediate track 63 above the tip 64 of the knitting cam/knitting element 48. From there, in a manner to be described below, the needle foot crosses underneath the cam element 66 and reaches the second knockover track 42 and passes under the needle sinker 22 and on into the discharge track 32. If a loop transfer without loop formation (knitting) is to be effected for a particular reason, that is, if an offset is planned for the knitted goods, then the indexable region 49 of the knitting cam/knitting element 48 is indexed out of the way, so that the needle foot of the receiving needle UN involved is moved along the lower receiving lobe or course 64' and into the first knockover track 47, from whence it moves under the suppressor cam element 68 and underneath the needle sinker 22 into the discharge track 32.

Selecting the tracks to be taken by the needle foot of the particular needle is done by preselecting the particular courses or planes of the feet in a known manner by means of intermediate jacks, not shown, such that pressing down or suppressing of the intermediate jack foot causes a pressing down or impressing of the needle foot into the needle bed, so that this particular needle foot is disengaged for the particular needle track, or can move away underneath some cam element. As shown in FIG. 1, the feet of the intermediate jacks (not shown) can be selectively displaced into four different planes 71–74, in which indexable and non-indexable bars of the pressure bar unit 14 are disposed. In the first plane 71, in which the delivery movement of a needle that is to deliver a loop takes place, there is no pressure bar; that is, the particular needle ÜG, or its foot, traverses the specified tracks in the needle cam unit 13 from beginning to end. In the second plane 72, which serves to deliver the respective needle ÜN+RR to the combined loop receiving and loop forming movement, there are, in the carriage travel direction A, a first, operative, pressure bar 76, which serves to cause the needle foot to travel under the needle sinker 21 and the cam element 69, a second pressure bar 77, which is inoperative in this carriage travel direction, a third, operative, pressure bar 78, which serves to cause the needle to travel under the cam element 66, and a fourth pressure bar 79, which in the trailing condition is inoperative. It will be understood that in the opposite direction A' of carriage travel, the pressure bars 77 and 79 are operative, while the pressure bars 76 and 78 are inoperative. In the third plane 73, which is associated with the tuck position of the associated needle F, three pressure bars 81–83 are provided, of which the first pressure bar in the carriage travel direction A effects travel underneath the needle sinker 21; the non-indexable, stationary second pressure bar 82 effects travel underneath the bar element 43, the knitting cam/knitting element 48 and the bar element 44; and the trailing third pressure bar 83 is inoperative. Here again, it will be understood that in the opposite travel direction A' the pressure bar 83 is operative and the pressure bar 81 is inoperative. In the fourth plane 74, which is associated with the inoperative or non-working position, a single, non-indexable, stationary pressure bar 84 is provided over the entire length or width of the needle cam unit 13; this pressure bar 84 causes the foot of the associated needle AVS to cross underneath all the cam elements of the needle cam unit 13.

As indicated above, it is also intended that a receiving movement on the part of a needle be possible even without a knitting or loop forming movement of this needle. To this end, instead of embodying the knitting cam/knitting element 48 with an indexable region 49, an indexable pressure bar can also be provided in this region in the second plane 72.

Figure 2A:
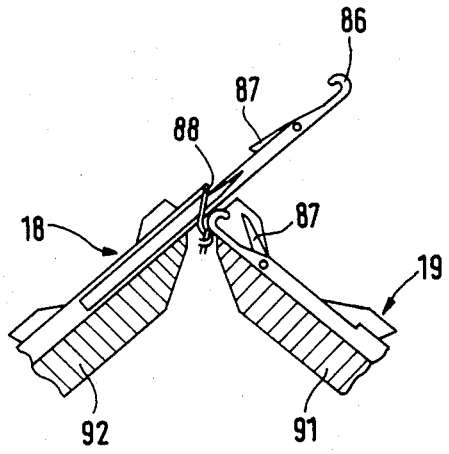
FIGS. 2A-2C are schematic, fragmentary views of cross sections through the two needle beds of a flat-bed knitting machine, in which the various drawings of a flat-bed knitting machine show successive positions of opposed needles during the process of simultaneous loop formation and loop transfer.

Turning now to FIG. 2, the combined transfer/knitting movement of two needles in the front and back needle beds 91, 92 of the flat-bed knitting machine will now be described. In the usual manner, the needle 18 that is delivering a loop 88 is projected into the first projection track 23 of the other needle bed 92 far enough that the loop 88 moves out of the needle hook 86 and comes to rest behind the opened latch 87. Once the loop 88 that is to be transferred is stretched along the biasing lobe 53 and the needle 18 that is delivering it is retracted a short way (indentation 56), the needle 19 receiving the loop 88 is projected (track 46), so that it can enter the back slit of the delivering needle 18 and pass into the loop 88 (see FIG. 2A). In this movement past the delivering needle 18, the latch 87 of the receiving needle 19 is opened by the loop 88.

Figure 2B:
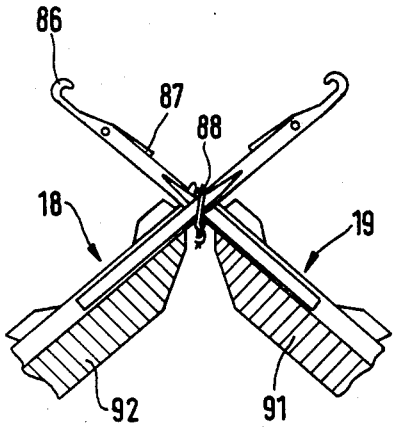
Figure 2C:
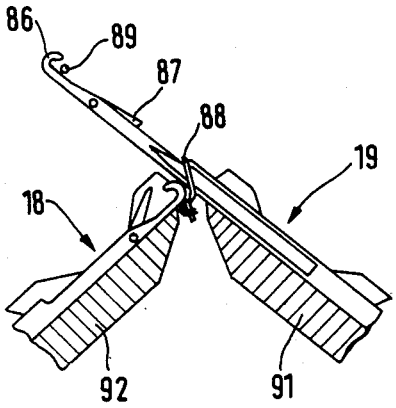

Now, unlike the receiving movement of the prior art, the receiving needle 19 is not left in this position; instead, it is projected along the operative cam element region 49 in the third projection track 46, far enough that the loop 88 that is to be transferred comes to rest behind the opened latch 87 of the receiving needle 19 (see FIG. 2B). During this projection movement of the receiving needle 19, a delivery projection movement takes place along the lobe 58 and an ensuing beginning knockover movement takes place along the track 61 of the delivering needle 18. While the receiving needle 19 initially remains in this position along the intermediate track portion 63, the delivering needle 18 is retracted along the first knockover track 47 and with the closure of the latch 87 moves out of the loop 88. Near the end of the first part of the knockover movement of the delivering needle 18, the knockover movement of the receiving needle 19 along the second knockover track 42 is initiated. In its projected position, however, the receiving needle 19 is prepared to receive a new yarn 89 with its hook 86 and to take it along during the knocking over (see FIG. 2C). In this process, the transferred loop 88 slips upward and closes the latch 87, so that the new yarn 89 is held enclosed in the needle hook 86 and can be pulled through underneath the transferred loop 88 in order to form a new loop. The combined process of receiving a loop 88 and forming a new loop using the yarn 89 is thereby ended.

It should also be noted that in the method according to the invention and in the embodiment of the needle cam unit 13 according to the invention, the individual needles that are projected along the entire third projection track 46 are always ready for receiving a loop; thus the only criterion is whether a delivery movement on the part of a needle of the opposite needle bed is taking place. In other words, if no delivery movement on the part of the opposite needle of the other needle bed is taking place, then all that happens is that a new loop is formed; but if there is a simultaneous delivery movement, then not only is an existing loop transferred, but a new loop is formed as well. If no new loop is to be formed and only a transfer is to be effected, then in the conventional manner, the receiving needle 19 is merely projected a short distance, because of the lower receiving lobe or course 64' that comes into effect in that case; as already mentioned, this can be effected either by indexing the cam element region 49 or by appropriate provision and indexing of a pressure bar in the second plane 72.

The above-described exemplary embodiment of a cam system 11 according to the invention employs pressure jacks which are selectively movable into various courses 71–74 as well as needles which in conjunction therewith can be pressed into the needle bed. The cam system and method for combined loop transfer and loop formation in one operation or one projection stroke according to the invention can also, however, be employed where pusher jacks cooperating with the needles and pusher cam units associated with these jacks are used, where appropriately indexable cam elements are used, for instance instead of the pressure bar unit, in both the needle cam unit and the pusher cam unit.

I claim:

1. In a cam system for flat-bed knitting machines having a needle cam unit including at least one combined knitting/transfer cam assembly for both carriage travel and transfer directions, said knitting/transfer cam assembly including a knitting cam and a transfer cam, the knitting cam including adjustable needle sinkers and a knitting cam/knitting element that raises needles for knitting, and the transfer cam including at least one transfer cam element and at least one receiving cam element associated therewith, the improvement wherein the knitting cam/knitting element also defines or forms the receiving cam element.

2. In the cam system for flat-bed knitting machines as defined in claim 1, further wherein the knitting cam/knitting element is divided in two with an upper region embodied such that it is indexable.

3. In the cam system for flat-bed knitting machines as defined in claim 1, said system further having needle beds within which needle tracks are formed, intermediate jacks embodied as pressure elements, and pressure bars in which the needles supported in needle tracks of the needle beds are controlled by the intermediate jacks, and the pressure feet of said pressure elements being movable into different courses located in the planes of the pressure bars, the improvement further wherein preferably four planes of pressure bars are provided, one of which effects the delivery transfer movement, another of which effects the loop forming and/or loop receiving movement, another of which effects the tuck position and the other of which effects the non-working position.

4. In the cam system for flat-bed knitting machines as defined in claim 3, the improvement further wherein the plane which effects the loop forming and/or loop receiving movement is provided with an indexable pressure bar in the region below the knitting cam/knitting element.

5. In the cam system for flat-bed knitting machines as defined in claim 1, said knitting/transfer cam assembly further including an intermediate cam element associated with each needle sinker, the improvement further wherein the leading needle sinker, which simultaneously embodies the delivery transfer element, and its associated intermediate cam element, situated between its associated needle sinker and the knitting cam/knitting element, are relatively disposed such that three needle projection tracks and three knockover tracks respectively situated in succession in the direction of carriage travel are formed, said tracks meeting in a region above the knitting cam/knitting element.

6. In the cam system for flat-bed knitting machines as defined in claim 5, wherein the delivery transfer movement, the tuck movement and the loop formation and/or loop receiving movement have knockover tracks associated therewith, the improvement further wherein one of the projection tracks is associated with the knockover track of the delivery transfer movement, another of the projection tracks is associated with the knockover track of the tuck movement, and the other of the projection tracks is associated with the knockover track of the loop formation and/or loop receiving movement.

7. In the cam system for flat-bed knitting machines as defined in claim 5, said knitting/transfer cam assembly further including a suppressor cam element, the improvement further wherein the suppressor cam element is situated in the region where said tracks meet above the knitting cam/knitting element and acts in suppression in the direction opposite to carriage travel.

8. In the cam system for flat-bed knitting machines as defined in claim 5, said knitting/transfer cam assembly further including suppressor cam elements, the improvement further wherein a suppressor cam element is situated at the branching point of the two projecting tracks nearest the knitting cam/knitting element, and at the branching point of the knockover tracks nearest the knitting cam/knitting element, said suppressor cam elements acting in suppression in the direction opposite to carriage travel.

9. A method for selectively forming loops on a flat-bed knitting machine provided with a front and a rear needle bed and transferring the loops from the needles of one needle bed to the needles of the other needle bed, preferably with the aid of latch needles, which serve as knitting needles during loop transfer, comprising the step of:

combining the loop transferring and loop forming operation by projecting the needle, which in one operation first receives a loop and then forms a loop, far enough so that a loop that is to be received slips behind the open needle latch of a receiving needle and a new yarn for loop formation can be grasped with the hook of the needle.

* * * * *